US009309023B2

(12) United States Patent
Hubbard, Jr. et al.

(10) Patent No.: US 9,309,023 B2
(45) Date of Patent: Apr. 12, 2016

(54) DUAL COMPARTMENT FOOD TRAY

(71) Applicant: LBP Manufacturing, Inc., Cicero, IL (US)

(72) Inventors: James A. Hubbard, Jr., Oak Lawn, IL (US); Kevin Jay Fultz, Orland Park, IL (US); Jonathan Craig Smyk, Atlanta, GA (US)

(73) Assignee: LBP Manufacturing LLC, Cicero, IL (US)

( * ) Notice: Subject to any disclaimer, the term of this patent is extended or adjusted under 35 U.S.C. 154(b) by 0 days.

(21) Appl. No.: 14/529,646

(22) Filed: Oct. 31, 2014

(65) Prior Publication Data

US 2015/0129650 A1 May 14, 2015

Related U.S. Application Data

(60) Provisional application No. 61/898,941, filed on Nov. 1, 2013.

(51) Int. Cl.
*B65D 5/20* (2006.01)
*B65D 5/487* (2006.01)
(Continued)

(52) U.S. Cl.
CPC ..... *B65D 5/48016* (2013.01); *B65D 5/2076* (2013.01); *B65D 5/241* (2013.01); *B65D 5/4204* (2013.01); *B65D 5/48018* (2013.01); *B65D 5/6605* (2013.01)

(58) Field of Classification Search
CPC ..... B65D 5/48002; B65D 5/6629; B65D 5/6632; B65D 5/2047; B65D 5/48016; B65D 5/48018; B65D 5/2052
USPC ..... 229/120.04, 127, 143, 162.7
See application file for complete search history.

(56) References Cited

U.S. PATENT DOCUMENTS 292,654 A 1/1884 Jaeger
306,532 A 10/1884 Schmidt
(Continued)

FOREIGN PATENT DOCUMENTS

FR 1125835 A 11/1956
FR 2088952 * 1/1972 ..... B65D 5/2047
(Continued)

OTHER PUBLICATIONS

Photo of food box believed to have been taken prior to Nov. 1, 2013 (1 page).
(Continued)

*Primary Examiner* — Gary Elkins
(74) *Attorney, Agent, or Firm* — Fitch, Even, Tabin & Flannery LLP

(57) ABSTRACT

A food tray including front and rear sidewalls each having left and right side edges. A left sidewall extends between respective left edges of the front and rear sidewalls. A right sidewall extends between respective right edges of the front and rear sidewall. A bottom panel extends between bottom edges of the front, rear, left and right sidewalls. The sidewalls define a container space for a food item. A left lid extends from a top edge of the left sidewall. A right lid extends from a top edge of the right sidewall. The left and right lids are configured to fold and cover the container space. The left lid includes a flap that extends from an edge of the left lid that is opposite the top edge of the left sidewall. The flap is configured to be folded into the container space to divide the container space into two compartments.

24 Claims, 6 Drawing Sheets

(51) Int. Cl.

| | |
|---|---|
| ***B65D 5/66*** | (2006.01) |
| ***B65D 5/48*** | (2006.01) |
| ***B65D 5/24*** | (2006.01) |
| ***B65D 5/42*** | (2006.01) |

(56) References Cited

U.S. PATENT DOCUMENTS

| | | | | |
|---|---|---|---|---|
| 667,634 | A | | 2/1901 | Schmidt |
| 926,208 | A | | 6/1909 | Palmer |
| 973,927 | A | | 10/1910 | Eddy |
| 1,440,233 | A | | 12/1922 | Noel |
| 1,505,045 | A | | 8/1924 | Lohrman |
| 1,794,631 | A | * | 3/1931 | Luckett ..... 229/125.39 |
| 2,072,753 | A | | 3/1937 | Ikeda et al. |
| 2,110,681 | A | | 3/1938 | Rutledge |
| 2,330,345 | A | | 9/1943 | Elliott |
| 2,330,521 | A | | 9/1943 | Scheide |
| 2,361,124 | A | | 10/1944 | Ringholz |
| 2,493,176 | A | | 1/1950 | Whitehead |
| 2,536,948 | A | | 1/1951 | Lehman |
| 2,675,160 | A | | 4/1954 | Buttery |
| 2,805,813 | A | | 9/1957 | Rittmueller |
| 2,843,307 | A | * | 7/1958 | Goltz ..... 206/509 |
| 2,854,182 | A | | 9/1958 | Dodd |
| 2,909,105 | A | | 10/1959 | Lawrence |
| 3,038,650 | A | | 6/1962 | Asman |
| 3,067,924 | A | | 12/1962 | Baker et al. |
| 3,105,626 | A | | 10/1963 | McCormick et al. |
| 3,126,142 | A | | 3/1964 | Goetz |
| 3,176,899 | A | | 4/1965 | McMahon |
| 3,231,172 | A | | 1/1966 | Strange |
| 3,330,467 | A | | 7/1967 | Johnson |
| 3,343,660 | A | | 9/1967 | Bailey |
| 3,554,402 | A | | 1/1971 | Lock |
| 3,603,502 | A | | 9/1971 | Howard et al. |
| 3,670,949 | A | | 6/1972 | Galanes |
| 3,684,159 | A | * | 8/1972 | Wolfe ..... 229/212 |
| 3,809,310 | A | | 5/1974 | Vanderlugt, Jr. |
| 3,949,931 | A | | 4/1976 | Hall |
| 4,105,155 | A | * | 8/1978 | Forbes, Jr. ..... 229/120 |
| 4,214,696 | A | | 7/1980 | Barton et al. |
| D259,615 | S | | 6/1981 | Morris, Jr. |
| 4,291,806 | A | | 9/1981 | Austin |
| D261,485 | S | | 10/1981 | Haubert |
| 4,294,397 | A | | 10/1981 | Kohler |
| 4,431,128 | A | | 2/1984 | Dirico |
| 4,645,122 | A | | 2/1987 | Nederveld |
| 4,694,987 | A | | 9/1987 | Forbes, Jr. |
| 4,747,536 | A | | 5/1988 | Wischusen, III |
| 4,804,137 | A | * | 2/1989 | Harby ..... 229/114 |
| 4,844,330 | A | | 7/1989 | Roosa et al. |
| 4,884,739 | A | | 12/1989 | Nederveld |
| 4,917,291 | A | | 4/1990 | Saiki et al. |
| 4,951,866 | A | | 8/1990 | Rusnak |
| 5,012,971 | A | | 5/1991 | Cozzi et al. |
| 5,039,003 | A | | 8/1991 | Gordon et al. |
| 5,213,256 | A | | 5/1993 | Cyr |
| 5,226,588 | A | | 7/1993 | Schramm et al. |
| 5,270,066 | A | * | 12/1993 | Pawlowski ..... 426/107 |
| D348,607 | S | | 7/1994 | Young |
| 5,370,303 | A | * | 12/1994 | Fry ..... 229/143 |
| 5,379,945 | A | | 1/1995 | Kataoka |
| 5,411,204 | A | | 5/1995 | Demay |
| 5,415,340 | A | | 5/1995 | Calvert et al. |
| 5,620,134 | A | | 4/1997 | Gulliver |
| 5,800,061 | A | | 9/1998 | Volles |
| 5,855,315 | A | * | 1/1999 | Roseth ..... 229/120.04 |
| 6,036,085 | A | | 3/2000 | Tsao |
| 6,050,483 | A | | 4/2000 | Haraldsson et al. |
| 6,223,979 | B1 | | 5/2001 | Correll |
| 6,543,679 | B2 | | 4/2003 | Cai et al. |
| 6,676,010 | B1 | | 1/2004 | Roseth et al. |
| D495,251 | S | | 8/2004 | Zack |
| 6,863,212 | B2 | | 3/2005 | Stone et al. |
| D519,366 | S | | 4/2006 | Epstein |
| D552,987 | S | | 10/2007 | Magnusson |
| 7,306,138 | B2 | | 12/2007 | Shadrach |
| 7,587,883 | B2 | | 9/2009 | Cook et al. |
| 7,631,800 | B2 | * | 12/2009 | Cai et al. ..... 229/120.18 |
| 7,878,146 | B2 | | 2/2011 | Vadis |
| 7,886,958 | B2 | | 2/2011 | Smith |
| 7,968,132 | B2 | | 6/2011 | Archie, Jr. |
| 7,980,452 | B2 | | 7/2011 | Burton |
| 8,109,433 | B2 | | 2/2012 | De Paula et al. |
| 8,523,049 | B2 | * | 9/2013 | Fitzwater ..... 229/146 |
| 2001/0004088 | A1 | | 6/2001 | Lau |
| 2004/0182916 | A1 | | 9/2004 | Roseth |
| 2004/0222109 | A1 | | 11/2004 | Pucillo et al. |
| 2009/0039144 | A1 | | 2/2009 | Hooi et al. |
| 2011/0308991 | A1 | * | 12/2011 | Hubbard et al. ..... 206/557 |
| 2012/0261298 | A1 | | 10/2012 | Hubbard, Jr. et al. |
| 2013/0341386 | A1 | | 12/2013 | Hubbard, Jr. et al. |

FOREIGN PATENT DOCUMENTS

| | | | |
|---|---|---|---|
| GB | 875653 | | 8/1961 |
| GB | 2427399 | A | 12/2006 |

OTHER PUBLICATIONS

International Search Report and Written Opinion, dated Apr. 21, 2015, for corresponding International Application No. PCT/US2014/063428, filed Oct. 31, 2014 (15 pages).

* cited by examiner

DUAL COMPARTMENT FOOD TRAY

CROSS-REFERENCE TO RELATED APPLICATION

This application claims the benefit of co-pending U.S. Provisional Application No. 61/898,941, filed Nov. 1, 2013.

BACKGROUND

Food trays are utilized to store food items, such as hamburgers, sandwiches and other food items that consist of one or more layers placed between two slices of bread. Other non-layered food items may be stored as well.

A typical food tray is made from a single piece of cardboard that is folded along various edges to form a container. The container may include a bottom panel and four sidewalls that define a space for storing the food item. A lid may extend from a top edge of one of the sidewalls and may be configured to fold about the edge to cover the space. The lid may include one or more tabs along one or more edges that are configured to fit within corresponding slots on the sidewalls to maintain the lid in a closed configuration.

When used to store sandwiches and hamburgers, an operator typically assembles the food item and then places the assembled food item within the food tray.

SUMMARY OF THE INVENTION

In a first aspect, a food tray includes front and rear sidewalls each having a left and a right side edge. A left sidewall extends between respective left edges of the front and rear sidewalls, and a right sidewall extends between respective right edges of the front and rear sidewall. A bottom panel extends between bottom edges of the front, rear, left and right sidewalls. The front, rear, left, and right sidewalls, and bottom panel define a container space for placement of a food item. A left lid extends from a top edge of the left sidewall, and a right lid extends from a top edge of the right sidewall. The left and right lids are configured to fold over and to cover the container space. The left lid includes a dividing flap that extends from a distal edge of the left lid that is opposite the top edge of the left sidewall. The dividing flap is configured to be folded into the container space to thereby divide the container space into a first compartment and a second compartment.

Other features and aspects of the invention, and the advantages that they present, will be, or will become, apparent to one with skill in the art upon examination of the following figures and detailed description. It is intended that all such additional features and advantages be included within this description, and be within the scope and protection of the claims.

DETAILED DESCRIPTION OF THE INVENTION

One problem with known food trays is that the freshness and integrity of the food item stored in the food tray is compromised by the mixing of hot and cold portions of the food item. The exemplary embodiments below describe a food tray that over-comes such deficiencies. The food tray includes a lid that, when closed, provides two separate compartments for storing different portions of a food item, such as a hamburger. For example, the cold side or portion of a hamburger (for example, the slice of a bun with the lettuce and other toppings) may be stored in one compartment on one side of the food tray, and the hot side or portion of the hamburger (for example, the cooked burger on a bottom slice of the bun) may be stored in the other compartment on the other side of the food tray. The cold and hot portions of the hamburger may be assembled in front of the customer, directly within the respective compartments of the food tray and served, unassembled, to the customer, as opposed to being assembled and placed in a food tray or box. The side-by-side placement of the two compartments also provides a more convenient, orderly, organized and sanitary way for the customer to add condiments. For example, the customer may simply place either of the two compartments of the food tray, with the respective cold portion and hot portion of the hamburger, below a condiment dispenser, and dispense one or more condiments directly onto either or both of the respective cold and hot portions of the hamburger, without having to first disassemble the cold portion of the hamburger from the hot portion of the hamburger. When finished, the customer may close the food tray until she finds a place where she may assemble and eat the hamburger.

Figure 1:
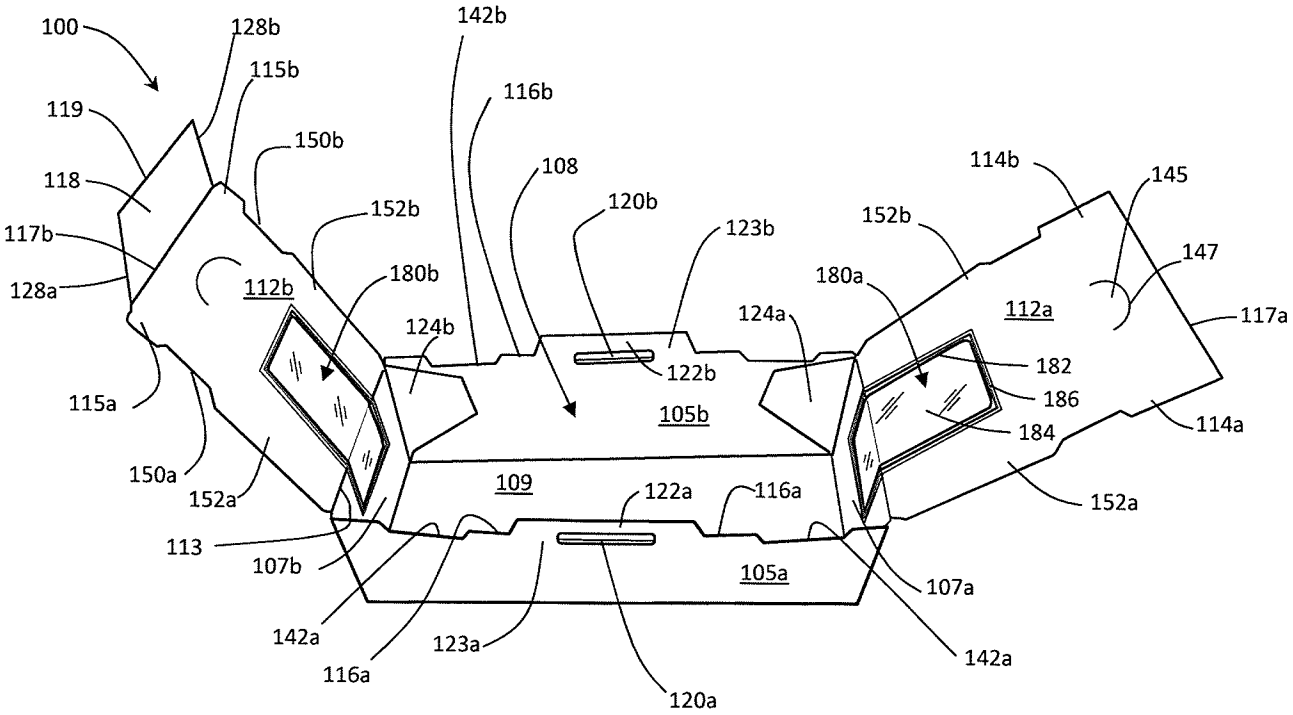
FIG. 1 illustrates a perspective view of a food tray that includes two lids in an open configuration.

FIG. 1 illustrates a perspective view of a non-limiting embodiment of a food tray 100 in an open configuration. The food tray 100 includes front and back sidewalls 105*a*,105*b*, right and left sidewalls 107*a*,107*b*, a bottom panel 109, and right and left lids 112*a*,112*b*. The bottom panel 109 extends between the respective lower edges of the four sidewalls (the front, back, left and right sidewalls 105*a*,105*b*, 107*a*, and 107*b*). The sidewalls and the bottom panel cooperate to define a container space 108 for storing a food item, such as sandwich, hamburger, etc. The container space has a generally elongated rectangular shape.

Figure 2:
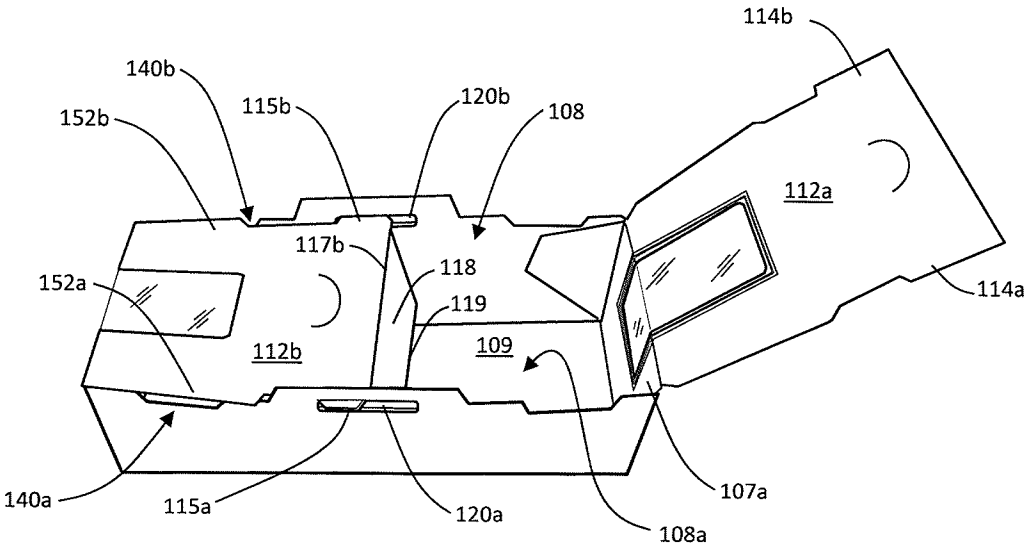
FIG. 2 illustrates the food tray of FIG. 1 with one of the lids in a closed configuration.

The left lid 112*b* includes a dividing flap 118 along a distal edge 117*b* of the lid, wherein the dividing flap 118 is configured to fold inward towards the bottom panel 109 when the left lid 112*b* is placed in the closed configuration, as illustrated in FIG. 2. Referring to FIG. 2, the dividing flap 118 divides the container space 108 within the food tray 100 into two compartments when the left lid 112*b* is in the closed configuration. This facilitates the placement of a first portion of, for example, the cold side or portion of a hamburger, into the left compartment 108*b* of the food tray 100 (under the left lid 112*b* in FIG. 2), and a second portion (e.g., the hot side or portion of the hamburger) into the right compartment 108*a* of the food tray 100. The dividing flap 118 separates the respective right and left portions of the hamburger, and prevents them from sliding together and mixing, which in turn helps to maintain the quality and appearance of the respective hamburger portions. The distal edge 117*b* of the left lid 112*b* from which the dividing flap 118 extends can extend horizontally in the closed configuration to be substantially centered within the compartment, between the right and left sidewalls 107*a*, 107*b*, so that when the dividing flap 118 is folded inwardly, the container space is divided into the two compartments of substantially equal size and volume. The relative sizes of the right and left lids 112*a*,112*b* can be configured differently so that distal edge 117*b* of the left lid 112*b* and the dividing flap 118 divide the container space into two compartments of different volumes.

The height of the dividing flap 118 (the distance it extends from the distal edge 117*b* of the lid 112*b* to a distal edge 119 of the dividing flap) can be sized to substantially match a distance between the inner surface of left lid 112*b* and the bottom panel 109 when the left lid 112*b* is in the closed configuration as shown in FIG. 2, so that the distal edge 119 of the dividing flap 118 contacts or almost contacts the bottom panel 109 when in the inwardly folded and closed-lid configuration. The lateral distance between, and the contour of, the opposed side edges 117*a*,117*b* of the dividing flap 118 can be configured to match a distance and contour between the front and rear sidewalls 105*a*,105*b*, so that the opposed side edges 117*a*,117*b* of the dividing flap 118 contact or almost contact the front and rear sidewalls 105*a*,105*b*. For example, the side edges 117*a*,117*b* of the dividing flap can be tapered to match the draft angle of the front and rear sidewalls 105*a*, 105*b*. This combination of features results in improved separation between, and isolation of the contents of, the two compartments 108*a*,108*b* of the container space 108.

Figure 3:
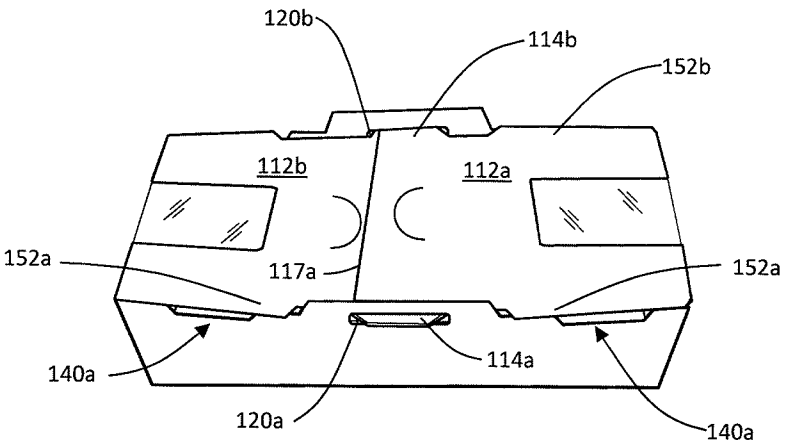
FIG. 3 illustrates the food tray of FIG. 1 with both lids in the closed configuration.

Referring to FIG. 3, the right lid 112*a* is folded to the closed configuration after the left lid 112*b* has been closed. In the closed configuration, the distal edge 117*a* of the right lid 112*a* overlaps the distal edge 117*b* of the left lid 112*b*, thereby completely covering both compartments of the container space.

Figure 4:
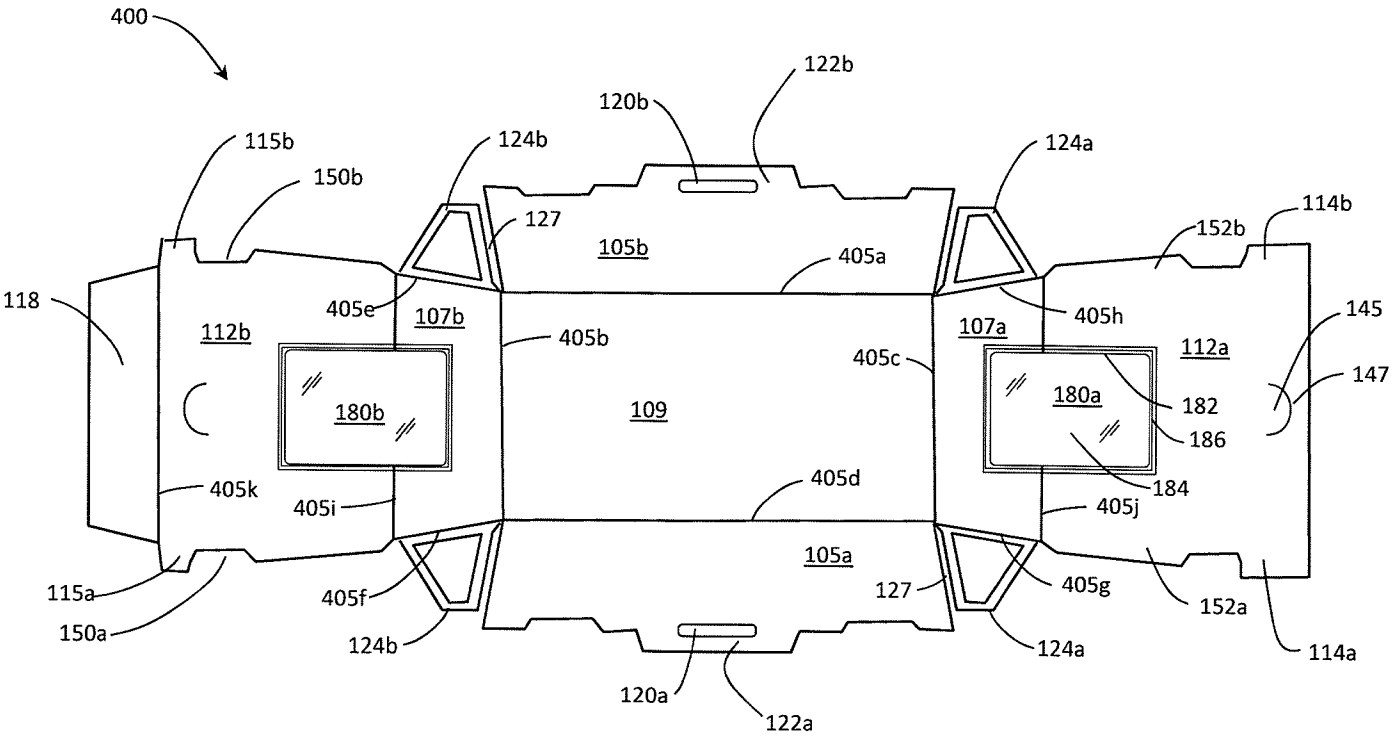
FIG. 4 illustrates a sheet of material that defines the various components of the food tray of FIG. 1 in an unassembled configuration.

The right and left sidewalls 107*a*,107*b* are secured to the front and back sidewalls 105*a*,105*b* at respective side edges. In one embodiment, the right and left sidewalls 107*a*,107*b* are attachable to the front and back sidewalls 105*a*,105*b*. An assembly flap can extend from the right and/or left sidewalls 107*a*,107*b* and be attachable to the respective front and back sidewalls 105*a*,105*b*. Alternatively, the assembly flap can extend from the front and back sidewalls 105*a*,105*b* and be attachable to the respective right and/or left sidewalls 107*a*, 107*b*. FIGS. 1 and 4 show an assembly flap 124*a* that extends from each of the front-side edge and back-side edge of the right sidewall 107*a*, and is folded, overlapped with, and attached adhesively to, the right end portions of the front sidewall 105*a* and back sidewall 105*b*. Likewise, an assembly flap 124*b* extends from each of the front-side edge and back-side edge of the left sidewall 107*b*, and is folded, overlapped with, and attachable adhesively to, the left end portions of the front sidewall 105*a* and back sidewall 105*b*. The assembly flaps 124*a* and 124*b* can be folded so that they are positioned to overlap and attach adhesively to inside surfaces of the front and back sidewalls 105*a*,105*b*, as illustrated, or to overlap with and attach adhesively to outside surfaces of the front and back sidewalls 105*a*,105*b*. In the illustrated embodiment, the assembly flaps are integral (unitary) with, and extend along a fold line with, the right and left sidewalls 107*a*,107*b*. In the sheet 400 shown in FIG. 4, the assembly flaps 124*a*,124*b* are separated from the respective front and back sidewalls 105*a*, 105*b* by a cut line, or by a removed portion of the distal end of the assembly flap, identified as a gullet 127.

In one embodiment, an adhesive can be used to secure each assembly flap 124*a* and 124*b* to a respective sidewall. The adhesive can include a pressure-sensitive adhesive, which is widely used and familiar to those skilled in the art. The adhesive can be pre-applied to a targeted area on the respective front, back or side walls, or to a targeted area on the assembly flaps 124*a*,124*b*, or both, to facilitate quick assembly of the food tray 100 in a restaurant setting. The walls can alternatively be secured together by other well-known means, including as an extending tab within a slot, mechanical fasteners, etc.

Figure 5:
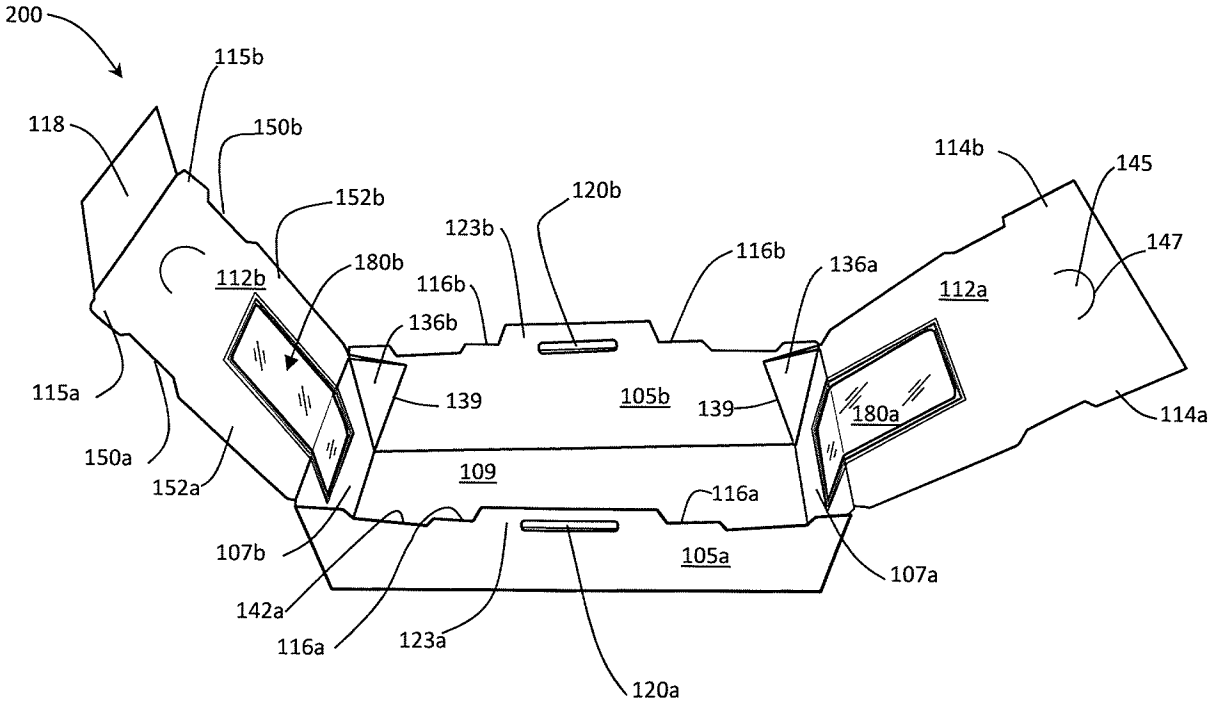
FIG. 5 illustrates a perspective view of another embodiment of a food tray that includes the two lids in an open configuration.
Figure 6:
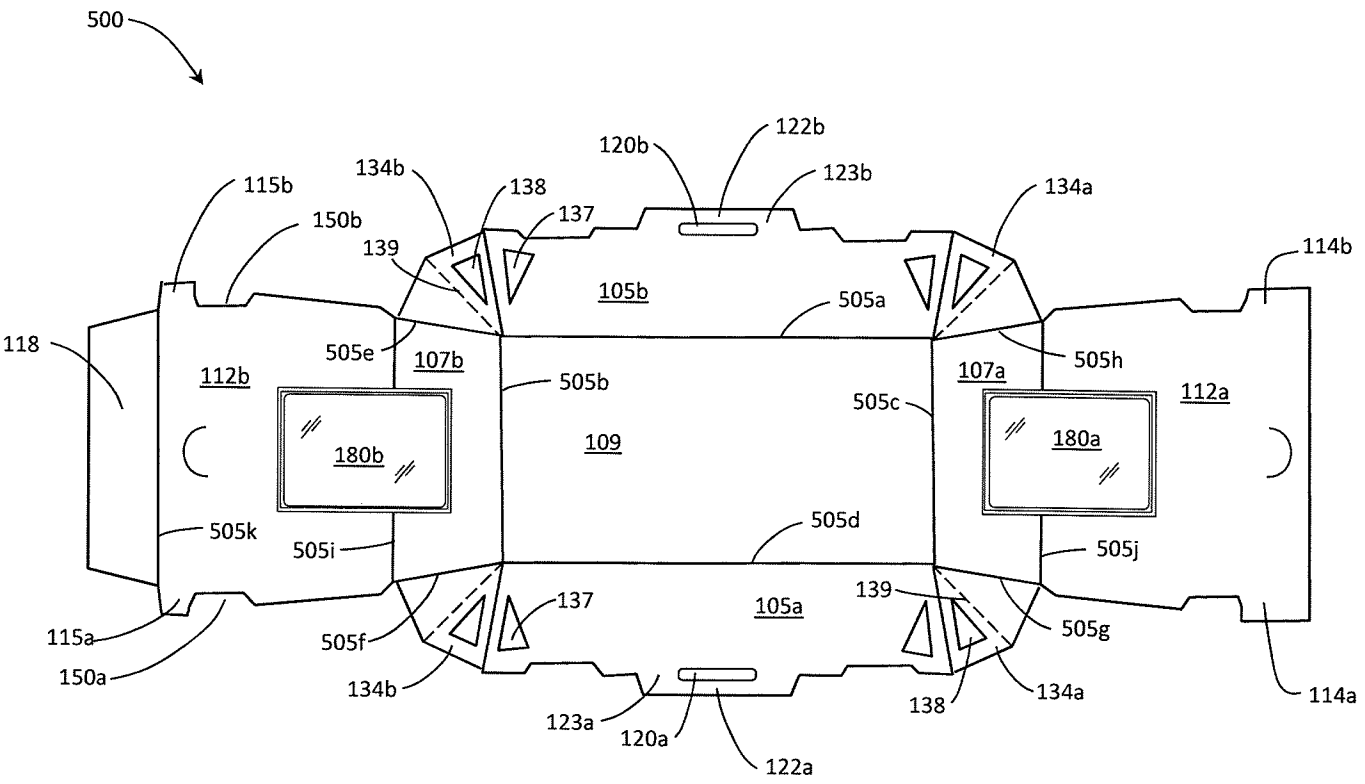
FIG. 6 illustrates a sheet of material that defines the various components of the food tray of FIG. 5 in an unassembled configuration.

In another embodiment shown in FIGS. 5 and 6, a food tray 200 can include a gusset can be attached between, and extended from and along the respective edges of, the left or right sidewall, and the front or back sidewall. In FIG. 6, a gusset 134*a* extends between the right edge of the back sidewall 105*b* and the back edge of the right sidewall 107*a*. Another gusset 134*a* extends between the right edge of the front sidewall 105*a* and the front edge of the right sidewall 107*a*. Likewise, another pair of gussets 134*b* extend between the left edges of the front and back sidewalls 105*a*,105*b*, and the respective front and rear edges of the left sidewall 107*b*. In the illustrated embodiment, the gussets are integral (unitary) with, and extend along fold lines from, the right or left sidewalls 107*a*,107*b*, the front or back sidewalls 105*a*,105*b*, and the adjacent bottom panel 109. The unitary gussets 134*a* and 134*b* facilitate the storage of food items within the container that contain liquids or juices, and the like, and prevent the seepage of the liquids or juices from the bottom of the food tray 200 that might otherwise escape between the adjacent sidewalls. The gussets include an intermediate fold line 139 to facilitate folding of the gusset to the inside of the food tray, as illustrated in FIG. 5. The folded gussets 136*a*,136*b* can be folded to overlap and attach adhesively to the inside surfaces of the front and back sidewalls 105*a*,105*b*, as illustrated, or to overlap and attach to the inside surfaces of the right and left sidewalls 107*a*,107*b*. Alternatively, the folded gussets can be folded to the outside of the food tray, and the folded gussets 136*a*,136*b* can be folded to overlap and attach adhesively to the outside surfaces of the front and back sidewalls 105*a*, 105*b*, or to overlap and attach to the outside surfaces of the right and left sidewalls 107*a*,107*b*, or a combination thereof. The adhesive can be used to secure each folded gusset 136*a*, 136*b* to the respective sidewall. The adhesive can be pre-applied to a target area 137 of either of the respective walls, or to a target area 138 on a fold of the gusset, or both, to facilitate quick assembly of the food tray 200 in a restaurant setting. The sidewalls can alternatively be secured by other well-known means, including as an extending tab within a slot, mechanical In some implementations, the respective sidewalls 105*a*, 105*b*, and 107*a*,107*b* are tapered, from the bottom panel upward and outward, to facilitate stacking of a plurality of assembled food trays 100,200. For example, the angle between each respective sidewall and a line that is normal to the bottom panel 109 of the food tray 100,200 is greater than 0°, and typically any angle from about 0.5° to about 35°.

In yet other implementations, one or more of the sidewalls and either or both of the lids can have a vent opening, which vents one or both of the separated compartments of the food tray 100. The venting of the compartments prevents a buildup of heat and/or humidity within the respective compartment within the food tray, which heat and/or humidity might otherwise cause the contents to become soggy. The vent openings can comprise a tab within the sidewall or lid that is separated, or can be separated, from the sidewall or lid along a perforated line or series of perforations in the sidewalls and/or lids to form a pivotable or pop-out tab to provide a vent opening in the respective sidewall or lid. FIG. 1 shows a tab 145 defined by a C-shaped score line 147 (or a line of perforations) in the lid. The tab can be pivoted or hinged inwardly open to form a vent opening.

A vent can also be formed between an edge in one of the front or back sidewalls and a surface of one or both of the lids, or between a surface of one of said sidewalls and an edge of the lid. FIGS. 1, 2 and 3 show at least one notch, including a pair of notches 142*a*,142*b* formed in an upper edge of the left and right sides of the front sidewall 105*a* and the back sidewall 105*b*, respectively. The notches 142*a*,142*b* cooperate with an inner surface of the side ledges 152*a*,152*b* of the left lid 112*b* and of the right lid 112*a*, when in the closed configuration, to form vent openings 140*a*,140*b*.

The right and left lids 112*a*,112*b* extend, respectively, from top edges of the right and left sidewalls 107*a*,107*b*. Each of right lid 112*a* and left 112*b* includes a pair of opposed tabs (114*a*,114*b* and 115*a*,115*b*) that extend from the side edges at the distal ends of the lids. The tabs can be inserted into opposed slots 120*a* and 120*b* formed in an upper slotted tabs 122*a*,122*b* of the front and back sidewalls 105*a*,105*b*, to thereby secure the lids 112*a*,112*b* in the closed configuration, as illustrated in FIGS. 2 and 3. The length of the tabs (114*a*, 114*b* and 115*a*,115*b*) may be sized in length to match the length of the slots 120*a*,120*b*. In addition, a notch 150*a*,150*b* in the front side edge and back side edge, respectively, of each lid 112*a*,112*b* confronts the inner surface 123*a*,123*b* of the upper slotted tabs 122*a*,122*b* of the front and back sidewalls 105*a*,105*b*, respectively, so that when the lids 112*a*,112*b* are in the closed configuration, the lids 112*a*,112*b* are substantially prevented from pivoting open, and shifting in a lateral/side-to-side direction. In alternative embodiments, a laterally-extending tab may be provided along a top edge of each of the front and back sidewalls, and slots may be provided in a tab on the left and right lids.

In a further embodiment of the invention, the upper edge of the front and back sidewalls 105*a*,105*b* includes left-side shoulders 116*a*,116*b* that support the forward portions of the side ledges 152*a*,152*b* of the lid, for stabilizing the lidded container and supporting the weight of a second container disposed on top of the lidded container.

In another embodiment, one or both lids can have an enlarged window opening 182, over which a clear, see-through film material 184 is secured to provide the lids 112*a*, 112*b* with a window 180, which facilitates viewing through the film material of the contents within the compartments of the food tray 100 when the lid 112*a*,112*b* is in the closed configuration. The film material 184 is sized larger than the opening 182, to extend over the edge of the lid defining the opening 182. The periphery of the film material 184 is attached to the lid using an adhesive, as is well known in the art. In another embodiment, the enlarged opening 182 may extend beyond the proximal or hinged edge 113 of the lid 112 and into an upper portion of the corresponding right and left sidewall 107*a*,107*b*, as illustrated in FIGS. 1 and 3.

In a further embodiment, the plastic film material 184 can include an anti-fog material or a film comprising an anti-fog agent coating the compartment-facing surface of the film material 184. These film materials include polypropylene, biaxially oriented polypropylene, films coated with polyvinylidene chloride and cellulose films. The film thicknesses are in the range of about 0.5 mils to about 2.5 mils.

As illustrated in FIGS. 4 and 6, the food tray 100,200 may be formed from a single sheet 400,500 of material, such as F fluted corrugated paper, paperboard, chipboard, plastic, or a different material. The sheet 400,500 may be coated to make the sheet 400,500 impervious to liquid, or may be uncoated.

The sheet 400 has a group of creases 405*a-k* that further define the respective sidewalls (105*a*,105*b*, 107*a*,107*b*), and bottom (109), lids 112*a*,112*b*, assembly flaps 124*a*,124*b*, and dividing flap 118. The food tray 100 may be assembled by first folding the assembly flaps 124*a*,124*b* along fold lines 405*efgh*, and then folding the right and left sidewalls 107*a*, 107*b* along fold lines 405*bc*. The front and back sidewalls 105*a*,105*b* are folded along fold lines 405*ad*, and then the assembly flaps 124*a*,124*b* are secured to front and back sidewalls 105*a*,105*b* to thereby form a container space for storing a food item.

After a food item or other object(s) is placed into the container space, the dividing flap 118 on the left lid 112*b* is folded inwardly along fold line 405*k*, to about perpendicular with the lid 112*b*, and then the left lid 112*b* is pivoted inwardly along fold line 405*i* to cover a left compartment 108*b* of the container space. The forward portions of the side ledges 152*a*,152*b* of the left lid 112*b* are placed on top of the shoulders 116*a*,116*b* of the front and back sidewalls 105*a*, 105*b*, and the tabs 115*a* and 115*b* are secured within the slots 120*a*,120*b* defined in the upper slotted tabs 122*a*,122*b* of the front and back sidewalls 105*a*,105*b*, to secure the left lid 112*b* in the closed configuration. The right lid 112*a* is then pivoted inwardly along fold line 405*j* to cover the right compartment of the container space. Likewise, the ledges 152*a*,152*b* of the right lid 112*a* are placed against the right-side shoulders 116*a*,116*b* of the front and back sidewalls 105*a*,105*b*, and the tabs 114*a* and 114*b* are secured within the same slots 120*a*, 120*b* to secure the right lid 112*a* in the closed configuration to thereby seal the contents within the two compartments of the food tray 100.

The sheet 500 (FIG. 6) has a group of creases 505*a-o* that further define the respective sidewalls (105*a*,105*b*, and 107*a*, 107*b*), and bottom (109), lids 112*a*,112*b*, gussets 134*a*,134*b*, and dividing flap 118. The food tray 200 can be assembled by first folding the gussets 134*a*,134*b* outwardly along fold line 139, and then inwardly along fold lines 505*efgh* and 505*lmno*, to form gusset flaps 136*a*,136*b* (FIG. 5). The right and left sidewalls 107*a*,107*b* are then folded along fold lines 505*bc*. The front and back sidewalls 105*a*,105*b* are folded along fold lines 505*ad*, and then the gusset flaps 136*a*,136*b* are secured to the inside surface of the front and back sidewalls 105*a*, 105*b*, to thereby form the container space for storing a food item.

While various embodiments have been described, it will be apparent to those of ordinary skill in the art that many more embodiments and implementations are possible that are within the scope of the claims. It is intended that the claims cover such embodiments and implementations.

We claim:

1. A food tray comprising:

a front sidewall and a rear sidewall, each having a left and a right side edge;

a left sidewall that extends between respective left edges of the front and rear sidewalls, and a right side wall that extends between respective right edges of the front and rear sidewalls;

a bottom panel extending between a bottom edge of the front, rear, left, and right sidewalls, wherein the front, rear, left, and right sidewalls, and the bottom panel define a container space for placement of a food item; and a left lid having a distal edge, the left lid extending from a top edge of the left sidewall, and a right lid that extends from a top edge of the right sidewall, wherein the left lid and right lid are configured to fold over and cover the container space, wherein the left lid includes a dividing flap that extends from the distal edge of the left lid that is opposite the top edge of the left sidewall, and the dividing flap is configured to extend into the container space when the left lid is folded over and covering the container space, to divide the container space into a first compartment and a second compartment;

wherein the right lid has a distal edge that overlaps the distal edge of the left lid when folded over and covering the container space;

wherein the left lid and the right lid have opposed side edges that overlap a portion of a top edge of the front sidewall and the rear sidewall when the left lid and the right lid are folded over and covering the container space;

wherein each of the left and right lids includes a first tab and a second tab that extend laterally at the distal edge on the opposite sides, and each of the front and back sidewalls has a top edge and further includes an upper tab extending upward from the top edge, and a slot proximate the upper tab for receiving both the first and second tabs of each of the left and right lids, to thereby maintain the left lid and right lid in a closed configuration.

2. The food tray according to claim 1, wherein the distal edge of the left lid from which the dividing flap extends is substantially centered between the right and left sidewalls when the left lid is in the closed configuration.

3. The food tray according to claim 1, wherein a distance that a distal edge of the dividing flap extends from the distal edge of the left lid, substantially matches a distance between an inside surface of the left lid and the bottom panel when the left lid is in a closed configuration.

4. The food tray according to claim 3, wherein a lateral distance between the side edges of the dividing flap substantially matches a distance between the front sidewall and rear sidewall.

5. The food tray according to claim 4, wherein the opposed side edges of the dividing flap are tapered to match a draft angle of the respective front sidewall and the rear sidewall.

6. The food tray according to claim 1, wherein each of the left and right sidewalls further comprises a pair of assembly flaps that respectively extend from a front edge and a back edge of each of the left sidewall and the right sidewall, wherein the assembly flaps are configured to fold against an inside surface of the respective front sidewall and back sidewall.

7. The food tray according to claim 6, further comprising an adhesive between each of the assembly flaps, and a corresponding inside surface of the front sidewall and the back sidewall, to secure the assembly flaps to the inside surfaces.

8. The food tray according to claim 1, wherein each of the front and back sidewalls further comprises a pair of assembly flaps that respectively extend from a left edge and a right edge of each of the front sidewalls and the back sidewall, wherein the assembly flaps are configured to fold against an inside surface of the respective left sidewall and right sidewall.

9. The food tray according to claim 1, further comprising a see-through film material positioned in an opening formed in at least one of the left lid and the right lid.

10. The food tray according to claim 9, wherein the opening extends into at least one of the left sidewall and the right sidewall.

11. The food tray according to claim 1, wherein the food tray is formed from a unitary sheet of material that comprises a material selected from the group of materials consisting of F fluted corrugated paper, paperboard, chipboard, and plastic.

12. The food tray according to claim 11, wherein the unitary sheet is coated with a material that rendered the sheet impervious to liquids.

13. The food tray according to claim 1, wherein the left, right, front, and rear sidewalls are tapered to facilitate nesting of a plurality of food trays.

14. The food tray according to claim 11, wherein the unitary sheet of material has a generally rectangular shape.

15. The food tray according to claim 1, further including a gusset that extends along a fold line between each of the left and right sidewalls, and each of the adjacent front and back sidewalls, wherein each gusset is folded along an internal fold line to form a gusset fold, and each gusset fold is configured to fold against either an inside surface or an outside surface of either the front or back sidewall, or of the adjacent left or right sidewall.

16. The food tray according to claim 15, further comprising an adhesive between each of the gusset flaps, and a corresponding inside surface of the front sidewall and the back sidewall, to secure the gusset flaps to the inside surfaces.

17. The food tray according to claim 1 wherein the top edge of at least one of the front sidewall and the rear sidewall has at least one relief portion spaced below other portions of the top edge, wherein the relief portion forms a vent opening in one of the front sidewall and the rear sidewall when the at least one of the left lid and the right lid are folded over and covering the container space such that a portion of at least one of the left and right lids above the relief portion forms an upper extent of the vent opening.

18. A food tray comprising:

a front sidewall and a rear sidewall, each having a left and a right side edge;

a left sidewall that extends between respective left edges of the front and rear sidewalls, and a right side wall that extends between respective right edges of the front and rear sidewalls;

a bottom panel extending between a bottom edge of the front, rear, left, and right sidewalls, wherein the front, rear, left, and right sidewalls, and the bottom panel define a container space for placement of a food item; and a left lid having a distal edge, the left lid extending from a top edge of the left sidewall, and a right lid that extends from a top edge of the right sidewall, wherein the left lid and right lid are configured to fold over and cover the container space, wherein the left lid includes a dividing flap that extends from the distal edge of the left lid that is opposite the top edge of the left sidewall, and the dividing flap is configured to extend into the container space when the left lid is folded over and covering the container space, to divide the container space into a first compartment and a second compartment;

wherein the right lid has a distal edge that overlaps the distal edge of the left lid when folded over and covering the container space;

wherein the left lid and the right lid have opposed side edges that overlap a portion of a top edge of the front sidewall and the rear sidewall when the left lid and the right lid are folded over and covering the container space; and wherein the left lid and the right lid have opposed side edges that taper outwardly from the proximal edge toward the distal edge.

19. A food tray comprising:

a front sidewall and a rear sidewall, each having top, left, and right side edges;

a left sidewall that extends between respective left edges of the front and rear sidewalls, and a right side wall that extends between respective right edges of the front and rear sidewall;

a bottom panel extending between a bottom edge of the front, rear, left and right sidewalls, wherein the front, rear, left, and right sidewalls, and the bottom panel define a container space for placement of a food item; and a left lid extending from a top edge of the left sidewall having a distal edge opposite from the top edge of the left sidewall and a pair of side edges extending therebetween;

a right lid extending from a top edge of the right sidewall having a distal edge opposite from the top edge of the right sidewall and a pair of side edges extending therebetween, wherein the left lid and right lid are configured to fold over and cover the container space a dividing flap of one of the left and right lids that extends from the distal edge thereof to extend into the container space when the one lid is folded over and covering the container space for dividing the container space into a first compartment and a second compartment;

a slot formed in each of the front and rear sidewalls spaced from the respective top edge thereof;

first and second tabs extending from the respective side edges of at least one of the left and right lids sized and configured to be received in the respective slots of the front and rear sidewalls for maintaining the at least one lid in a closed orientation.

20. The food tray of claim 19, wherein both of the left and right lids include the first and second tabs, and the first and second tabs of the lid having the dividing flap each have a length in the direction of the slot no longer than half of a length of the slot in which the respective tab is received.

21. The food tray of claim 19, wherein both of the left and right lids include the first and second tabs and the lid without the dividing flap is sized and configured to lay over a portion of the other lid when both lids are in the closed orientation with the tabs received in the respective slots.

22. The food tray of claim 19, wherein the side edges of the lids include portions that extend over and beyond the top edges of the respective front and rear walls such that portions of the top edges provide support to the lids when the lids are in the closed orientation.

23. The food tray of claim 22, wherein the front and rear walls include upwardly extending tab portions that extend above the slots in the front and rear walls.

24. The food tray of claim 23, wherein both of the left and right lids include the first and second tabs, and the side edges of the lids include notch portions adjacent the first and second tabs for engaging with inner surfaces of the upwardly extending tab portions such that portions of the lids are positioned therebetween when in the closed orientation to inhibit shifting of the lids in a front-to-rear direction.

* * * * *